US007247040B2

(12) United States Patent
Lingemann et al.

(10) Patent No.: US 7,247,040 B2
(45) Date of Patent: Jul. 24, 2007

(54) HOLDER FOR BIPIN TUBE-TYPE FLUORESCENT LAMP

(75) Inventors: Erwin Lingemann, Arnsberg (DE); Hartmut Greschner, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 11/634,228

(22) Filed: Dec. 5, 2006

(65) Prior Publication Data

US 2007/0077801 A1 Apr. 5, 2007

Related U.S. Application Data

(63) Continuation of application No. 11/069,571, filed on Feb. 28, 2005, now Pat. No. 7,153,151.

(30) Foreign Application Priority Data

Mar. 10, 2004 (DE) ..... 10 2004 011 635

(51) Int. Cl.
*H01R 33/08* (2006.01)
*H01R 33/02* (2006.01)

(52) U.S. Cl. ..... 439/239

(58) Field of Classification Search ..... 439/226, 439/239–244, 229, 227, 233, 236
See application file for complete search history.

(56) References Cited

U.S. PATENT DOCUMENTS 3,975,073 A * 8/1976 McLaughlin ..... 439/241

FOREIGN PATENT DOCUMENTS

EP 0 735 630 * 10/1996

* cited by examiner

*Primary Examiner*—Javaid H. Nasri
(74) *Attorney, Agent, or Firm*—Andrew Wilford

(57) ABSTRACT

A lampholder has an inner part centered on an axis and formed with a radially extending and axially open inner slot having a predetermined small width. It also has an outer part surrounding the inner part and formed relative to the axis with a radially extending and axially open outer slot of a predetermined large width. A lamp pin of a width greater than the small width but smaller than the large width cannot slide through the outer slot into the inner slot. The inner part is separable from the outer part.

1 Claim, 4 Drawing Sheets

HOLDER FOR BIPIN TUBE-TYPE FLUORESCENT LAMP

CROSS REFERENCE TO RELATED APPLICATIONS

This application is a continuation of application Ser. No. 11/069,571 filed Feb. 28, 2005 (now U.S. Pat. No. 7,153,151) with a claim to the priority of German patent application 10 2004 011 635.0 itself filed 10 Mar. 2004.

FIELD OF THE INVENTION

The present invention relates to a lampholder. More particularly this invention concerns a holder for a bipin tube-type lamp, normally fluorescent.

BACKGROUND OF THE INVENTION

A tube-shaped lamp, normally fluorescent, is known having at each end a pair of connector pins that extend axially at a standardized spacing. These pins allow the lamp to be powered when it is on and allow it to be ignited at the start of use, typically by applying a short-duration high-voltage burst between two of the pins.

The standard medium bipin base has been replaced with several other formats that correspond to lamps operating at different starting and operating voltages. Thus, although the pin spacing and length is normally the same, the pins are differently shaped so that, in theory, a lamp cannot be fitted to a fixture that is not adapted to run it. Thus while a medium bipin base has two cylindrical pins of uniform cross-sectional size, a G5 base has two pins of flattened or oval section that may be formed with grooves. Fitting a fixture with a lamp that is supposed to be started with or operate at a different voltage can lead to damage not only to the lamp, but to the fixture.

Thus it is the responsibility of the manufacturer of the lampholders to produce them in the different sizes required by the different lamps. This poses a manufacturing and inventory problem as, not only must the different holders be produced according to different specifications, but they must stocked, marketed, and cataloged individually. The obvious result is to increase the cost of the lampholders, produced in huge quantities by mass production, thereby raising the costs of the fixtures they are incorporated into.

OBJECTS OF THE INVENTION

It is therefore an object of the present invention to provide an improved holder for bipin tube-type fluorescent lamp.

Another object is the provision of such an improved holder for bipin tube-type fluorescent lamp that overcomes the above-given disadvantages, in particular that allows holders for different lamps to be produced at low cost.

SUMMARY OF THE INVENTION

A lampholder having an inner part and an outer part is formed relative to an axis with a radially extending and axially open slot in turn having an inner portion in the inner part and an outer portion in the outer part. The portions are alignable with each other and both have a predetermined large width. According to the invention an adapter has a body shaped to fit with one of the lampholder parts and having a formation engaged in the respective slot portion to define therein an adapter slot aligned with the respective slot portion and of a small width substantially less than the predetermined large width so that a lamp pin of a width greater than the small width but smaller than the large width cannot slide through the one slot portion. The adapter body is fixed to the one part of the lampholder.

It is therefore possible to use a standard wide-slot lampholder with the newer narrow-pin lamps. Instead of having to rebuild the entire lampholder, it is merely equipped with an adapter that makes it impossible to fit a fat-pin lamp into the holder. The adapter can be produced at minor cost and can be added to the lampholder on installation of the holder in a fixture by the assembler. Thus it is not necessary to manufacture and stock a wide variety of lampholders; instead a basic lampholder can be equipped with different adapters for use with different lamps, at much less cost.

The inner part of the lampholder is normally a rotor received in the outer part and rotatable about the axis in the outer part. In one embodiment the one part is the outer part and the adapter is U-shaped and fitted over the outer part. Thus the adapter can be an inexpensive injection-molded plastic element. According to the invention the adapter can be of a different color than the lampholder, to accurately show what style of lamp the holder has been adapted for.

The outer part is formed adjacent the slot with an outwardly open hole that can in fact be the normally formed test holes for the lampholder. In this case the adapter body has two arms fitted into the holes. The arms are each formed with a barb engaged with the lampholder. Thus it is possible to simply snap the adapter on the lampholder, although it is also within the scope of the invention to secure it with adhesive or a weld.

To best center the adapter, its body is formed with a pair of lips defining the adapter slot and projecting into the outer slot portion. In addition the outer part has a generally cylindrical outer surface, and the adapter body has a generally cylindrical inner surface fitted to the outer-part outer surface. Furthermore the adapter body has a generally cylindrical outer surface generally parallel to its inner surface.

In another arrangement according to the invention the one part is the inner part and the adapter body is an insert in the inner part. Thus the rotor of the lampholder is equipped with the adapter to restrict the width of the inner part of the pin-receiving slot extending diametrally across the holder.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
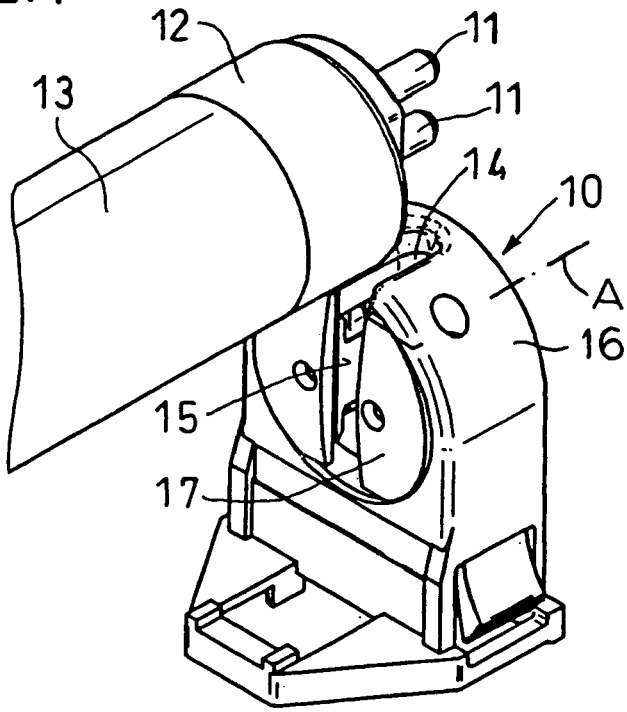
FIG. 1 is a perspective view of a prior-art lampholder with a standard bipin-base lamp.

As seen in FIG. 1 a standard lampholder 10 is made to hold a lamp 13 having a base 12 with a pair of standard parallel cylindrical pins 11. The holder 10 has a body 16 holding a rotor 17. The body 16 is formed with a slot 14 of a relatively great width W (FIG. 5) and the rotor 17 with a slot 15 of the same width W. The pins 11 of the lamp 13 are of a diameter that is slightly less than the width W. This structure corresponds to that described in EP 0,735,630. In use the lamp 13 is pushed perpendicularly to a center axis A of the rotor 17 so that the pins 11 pass down through the outer slot 14 and into the slot 15 of the rotor 17. Then the lamp 13 and rotor 17 are. rotated about the axis A to lock the bulb 13 in place and make the desired electrical connections to the pins 11.

According to the invention the holder 10 is equipped with an adapter 18 shown in FIGS. 2 through 8 and forming a slot 19 of a width w that is substantially less than the width W. As best shown in FIGS. 4 through 8, the adapter 18 has a one-piece body formed of injection-molded plastic. It has a part-cylindrical inner surface that fits with a part-cylindrical outer surface of the holder 10, and has a part-cylindrical outer surface parallel to its inner surface so that it is of uniform thickness. The adapter 18 is of a color that is normally different from that of the holder 10 and that is keyed to the width w of its slot 19, thereby indicating the format of the lamp it is to be used with.

The holder 10 is formed to each side of the outer slot 14 with a pair of outwardly open holes 22 that are normally used as the so-called Top Test holes through which electrical probes can be inserted to check the fitting. The concave inner face of the adapter 18 is formed with a pair of arms 20 that project into these holes 22 and that have barbed inner ends 21 that catch on sides 23 of the holes 22, thereby solidly locking the adapter 18 to the holder 10, so solidly that it is normally necessary to break the adapter 18 to remove it.

Figure 2:
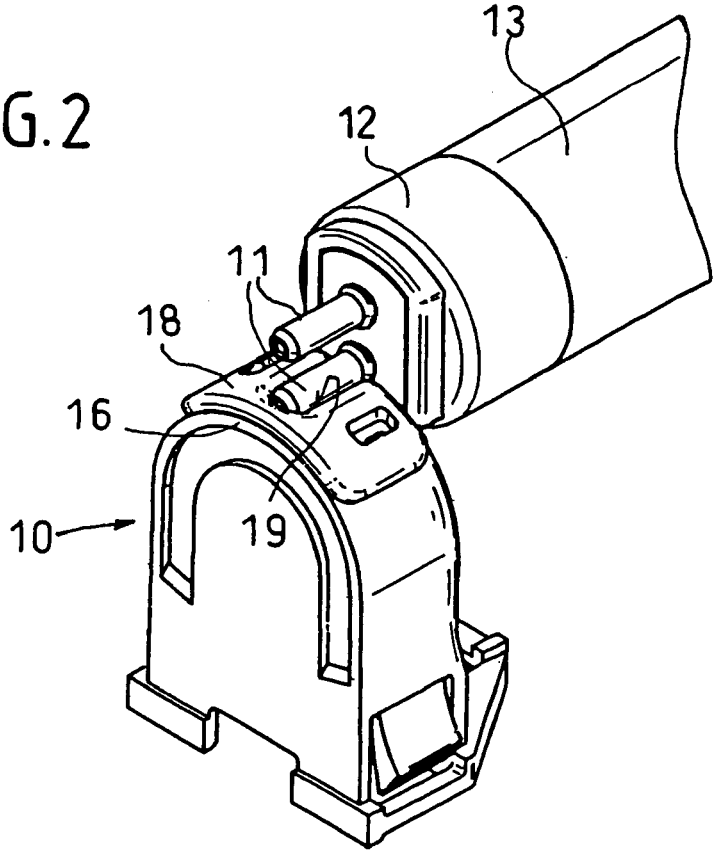
PRIOR ART FIG.2
FIG. 2 is a perspective view of the lampholder equipped according to the invention with an adapter for holding a lamp with a different bipin base.
Figure 4:
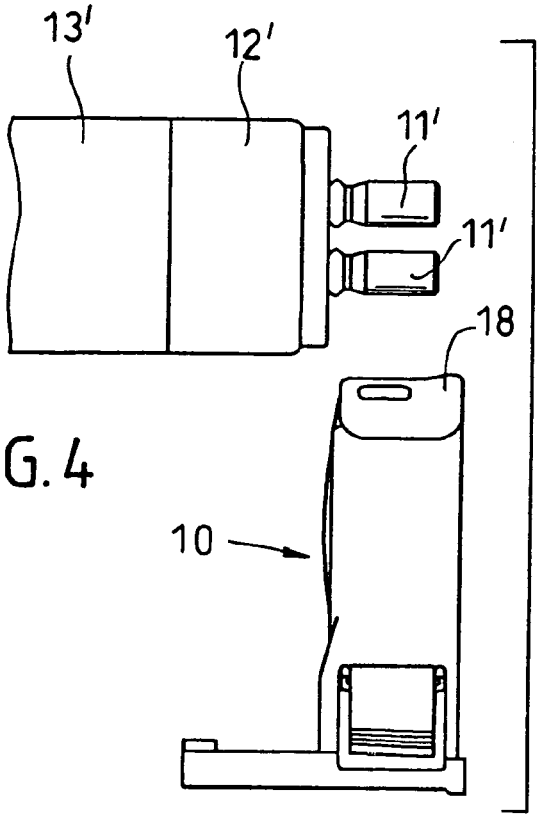
FIGS. 4 and 5 are side and end views of the structure of FIG. 3.
Figure 5:
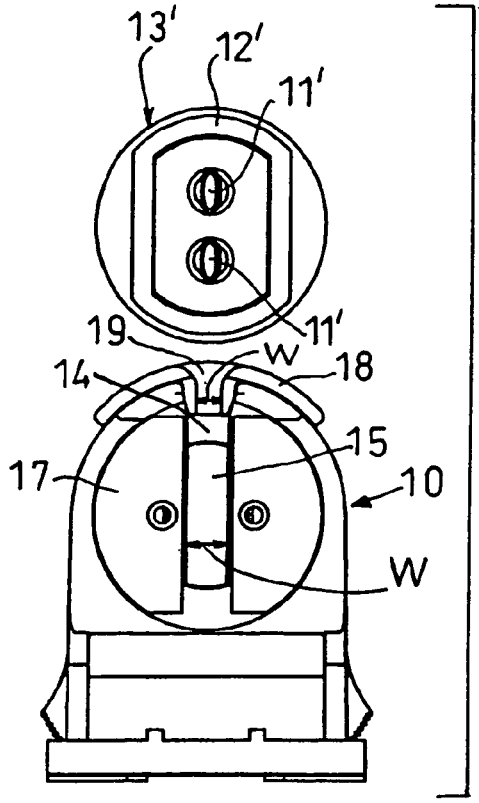
Figure 3:
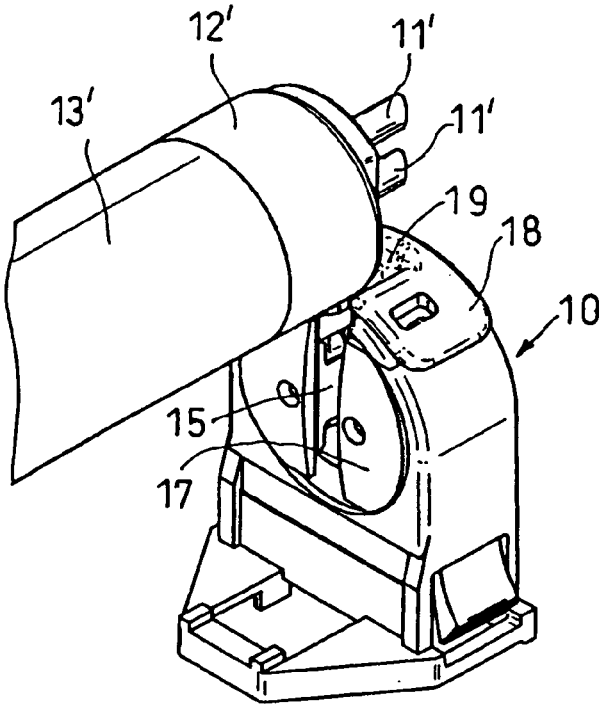
FIG. 3 is a view like FIG. 2 but taken in the opposite direction.
Figure 6:
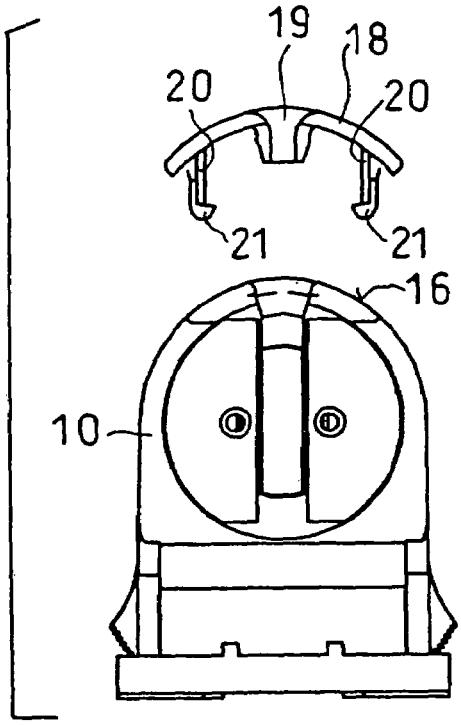
FIGS. 6 and 7 are end and perspective exploded end views. of the holder and adapter according to the invention.
Figure 7:
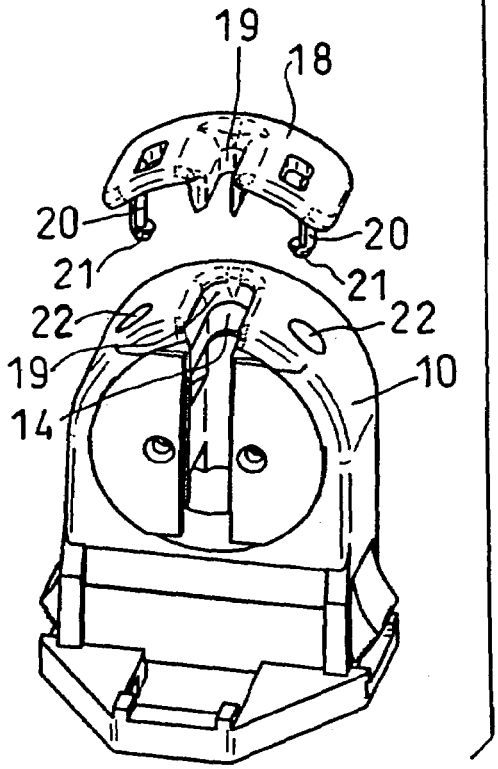
Figure 8:
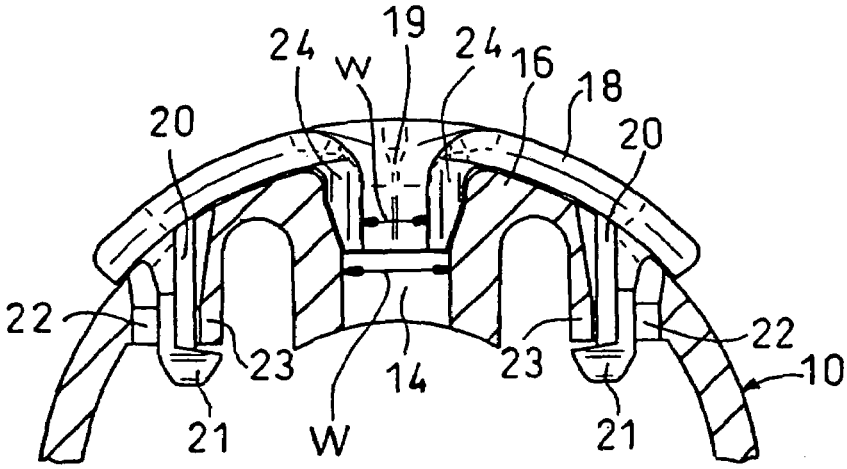
FIG. 8 is a large-scale cross section through the lampholder and adapter in accordance with the invention.

In addition to ensure that the adapter 18 fits solidly on the holder 10, it has lips 24 flanking and defining its slot 19 and fitting into the outer slot 14 of the holder 10. Thus as shown in FIG. 2, it is impossible for a standard-pin lamp 13 to be fitted in the lampholder 10 once it is equipped with the adapter 18. As shown in FIGS. 3, 4, and 5, however, a lamp 13' having a base 12' with narrow oval-section pins 1', e.g. of the G5 type, can be fitted through the slot 19 into the holder 10.

Figure 10:
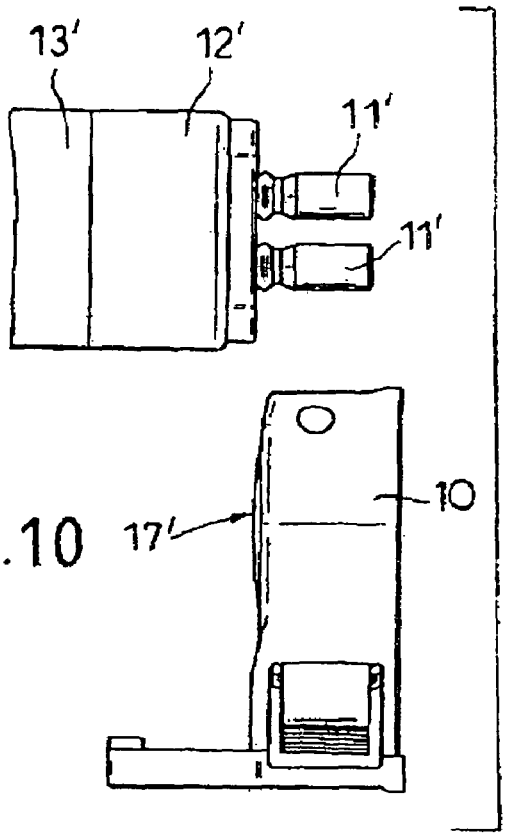
FIGS. 10 and 11 are side and end views of the structure of the structure of FIG. 9.
Figure 11:
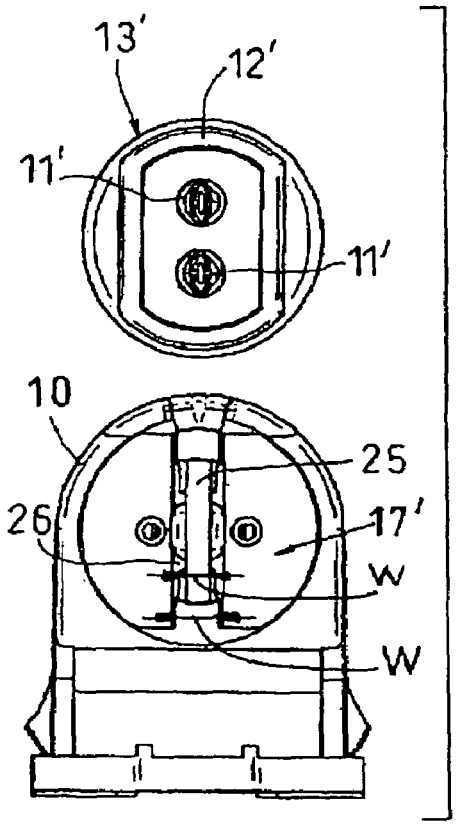
Figure 9:
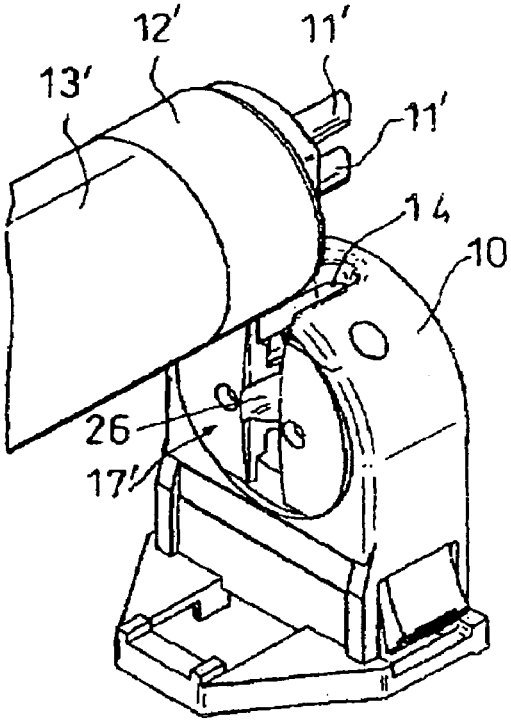
FIG. 9 is a perspective view of the inventive lampholder and adapter with a lamp having a different bipin base.

FIGS. 9 through 11 shown another arrangement where an adapter is formed as an insert 26 that is fitted to or part of a rotor 17' of the holder 10 and that has a slot 25 of the narrow width w. This adapter/insert 26 or rotor 17' can be used instead of or even in addition to the adapter 18 of FIGS. 2 through 9. The rotor 17' and/or its insert 26 can be differently colored from the rest of the holder 10 as described above to indicate that the holder 10 has been adapted for use with a particular type or lamp.

Figure 12:
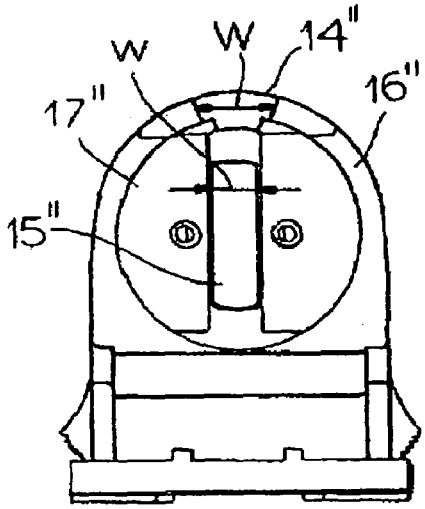
FIG. 12 is an end view of another embodiment of the invention.

In another arrangement according to the invention as shown in FIG. 12 the inner part or rotor 17" has a slot 15" of the narrow width w and the body or outer part 16" has a slot 14" of the wide width w extending diametrally across the holder.

We claim:

1. A lampholder comprising:

an inner part centered on an axis and formed with a radially extending and axially open inner slot having a predetermined small width; and an outer part surrounding the inner part and formed relative to the axis with a radially extending and axially open outer slot of a predetermined large width greater than the small width, whereby a lamp pin of a width greater than the small width but smaller than the large width cannot slide through the outer slot into the inner slot, the inner part being removable from the outer part.

* * * * *